United States Patent [19]

Hanson

[11] 3,970,241

[45] July 20, 1976

[54] FLAT BOTTOM BAG

[76] Inventor: Violet M. Hanson, 14 Fairway Drive, Old Bethpage, N.Y. 11804

[22] Filed: July 31, 1975

[21] Appl. No.: 600,277

Related U.S. Application Data

[62] Division of Ser. No. 376,112, July 3, 1973, Pat. No. 3,916,770.

[52] U.S. Cl. ..... 229/58; 229/53

[51] Int. Cl.[2] ..... B65D 33/00

[58] Field of Search ..... 229/58, 53

[56] References Cited

UNITED STATES PATENTS

| | | | |
|---|---|---|---|
| 904,169 | 11/1908 | Widmer | 229/58 |
| 3,185,384 | 5/1965 | Ragan et al. | 229/58 |
| R27,838 | 12/1973 | Leasure et al. | 229/58 |

FOREIGN PATENTS OR APPLICATIONS

| | | | |
|---|---|---|---|
| 680,290 | 8/1939 | Germany | 229/58 |

*Primary Examiner*—William Price
*Assistant Examiner*—Douglas B. Farrow
*Attorney, Agent, or Firm*—Bauer, Amer & King

[57] ABSTRACT

The invention relates to a flat bottom plastic bag and to methods of forming the same in which the bag is provided with an initial closed bottom that is further sealed between the bottom and the sides to produce a double-sealed, double-thickness closure.

9 Claims, 12 Drawing Figures

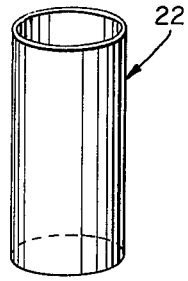
FIG. 2
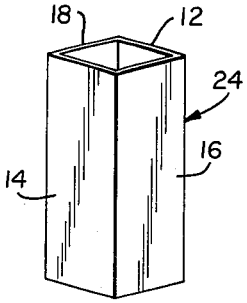
FIG. 3
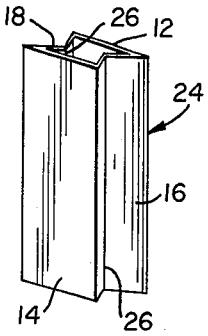
FIG. 4
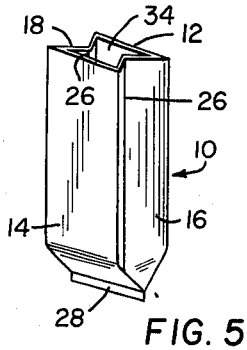
FIG. 5
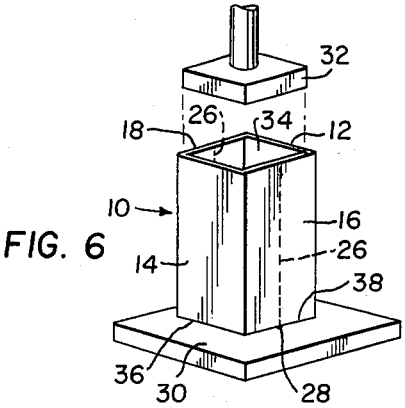
FIG. 6
FIG. 7
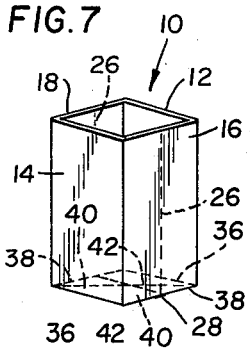
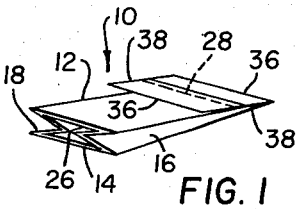
FIG. 1
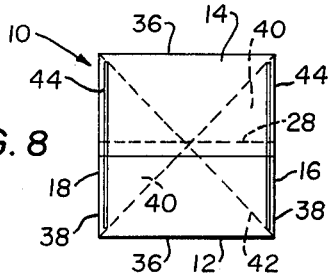
FIG. 8
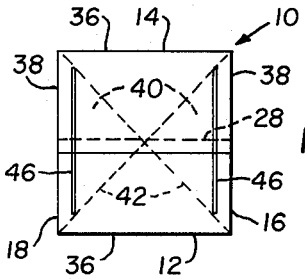
FIG. 9
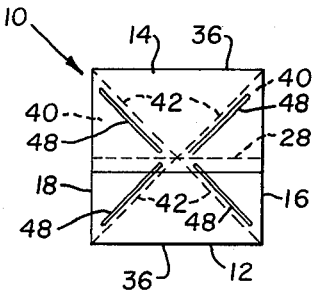
FIG. 10
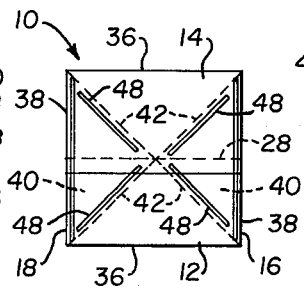
FIG. 11
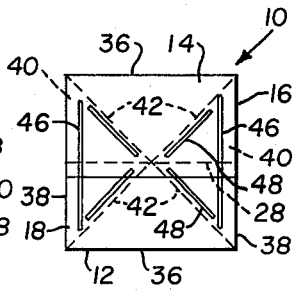
FIG. 12

FLAT BOTTOM BAG

This is a division, of application Ser. No. 376,112, filed July 3, 1973 now U.S. Pat. No. 3,916,770.

BACKGROUND OF THE INVENTION

In the past, methods of making flat bottom bags and bags formed thereby have required the formation of numerous seals or seams that resulted in a bag having a bottom of single thickness, more often of non-reinforced construction. Examples of such bags may be found in United States Letters Patent No. 3,237,845 to Piazze and No. 3,319,540 to Stengle, Jr. Bags having multiple folds at the bottom but with punctured corners may be found in the U.S. Pat. to Reiche No. 3,435,736.

SUMMARY OF THE INVENTION

This invention relates to flat bottom bags constructed of any desired material including plastic, paper and cloth or combinations thereof and to methods of making the same.

More particularly, the invention is directed to a bag as an article of manufacture having a double-thick, double-sealed flat bottom produced by methods in which the sides of the bag are gusseted inward between opposed faces and joined thereto during the initial sealing and closing of the bag. Thereafter, further sealing and joining of the faces and sides together at preselected adjacent portions after the bottom of the bag is pressed flat to position such portions of the gusseted sides of the face in overlying relationship, results in the production of a double-thick, double-sealed, reinforced flat bottom.

The resultant object and feature of the invention is the production of a bag of reinforced construction that is imperforate and that is capable of carrying solids, granular, and liquid materials.

Another object and feature of the invention is the production of a bag that has a self-sustaining shaped flat bottom of any desired shape, as square or rectangular, and that is maintained in such shape regardless of how the remainder of the bag is folded, and further, that because of its double-sealed, double-thick reinforced construction, is capable of supporting weights in excess of those capable of being supported by presently known bag constructions.

Another object of the invention is to provide a flat bottom bag and method of making the same that enables the use of presently existing bag making machinery with small or minimal adaptation.

The above description, as well as further objects, features and advantages of the present invention, will be more fully appreciated by reference to the following detailed description of a presently preferred, but nonetheless illustrative, embodiment in accordance with the present invention, when taken in conjunction with the accompanying drawings, wherein:

FIG. 1 is a perspective view of a flat bottom bag contructed according to the teaching of the invention and shown in folded condition;

FIG. 2 is a perspective view of a cylinder that may be used in forming the flat bottom bag;

FIG. 3 is a perspective view of a sleeve that may be used in forming the flat bottom bag;

FIG. 4 is a perspective view of the sleeve provided with gusseted sides;

FIG. 5 shows the application of the first seal;

FIG. 6 shows the step for pressing flat the bag bottom;

FIG. 7 is a view of the bag produced in FIG. 6;

FIG. 8 is a bottom view showing one arrangement of double seals;

FIG. 9 shows another arrangement of double seals;

FIG. 10 shows still another arrangement of double seals;

FIG. 11 shows a combination of the seals of FIGS. 8 and 10; and

FIG. 12 shows still another combination of seals as illustrated in FIGS. 9 and 10.

Referring now to the drawing, a flat bottom bag constructed according to the invention is illustrated in folded condition in FIG. 1 and is generally identified by the numeral 10. The same comprises opposing or oppositely disposed faces 12 and 14 that have alternately positioned between them side walls 16 and 18. The sides 16 and 18 are sealed closed to the faces 12 and 14 at an initial joining and closing seam 28.

Referring to FIG. 2, it will be seen that the cylinder there shown may be the shape of the initial or starting material. The same may be formed of plastic, paper, cloth or any combination thereof. It may be extruded as a single cylindrical shape or the cylindrical shape may have been formed from a flat sheet of material rolled and seamed to assume the shape as there shown. Thus, for convenience, the cylindrical shape of FIG. 2 is generally identified by the numeral 22.

In the making of the bag 10 as shown in FIG. 1, the cylinder 22 may then be shaped with the opposed faces 12 and 14 and the opposed interspaced sides 16 and 18, such as is illustrated in FIG. 3. On the other hand, the discretely sided sleeve shown in FIG. 3, and generally identified by the numeral 24, may be separately or individually formed without first utilizing the cylindrical shape 22 as illustrated in FIG. 2. That is to say, the sleeve 24 may be extruded or it may be formed of a flat sheet of material having a seam along any one of its corners or four walls. Because it is possible to form the sleeve 24 as a unitary element without initial seams, the illustration in FIG. 3 does not show any seams at all.

It is to be understood that it is immaterial as to how the sleeve 24 is formed. It is unimportant whether it is formed in the shape such as shown in FIG. 3, or whether it is first formed as a cylinder 22 as illustrated in FIG. 2 and thereafter provided with the discrete walls 12, 14, 16 and 18 to result in the sleeve 24 as shown in FIG. 3. In any event, the sleeve member 24 illustrated in FIG. 3 is denominated as a sleeve to distinguish it from the cylinder 22 of FIG. 2 and once so shaped as a sleeve, having discrete sides and faces, the teaching of the present invention may be utilized to form the flat bottom bag 10 illustrated in FIG. 1.

Initially, the sleeve 24 is gusseted along the opposed sides 16 and 18 to be provided with longitudinal fold lines 26. After being so gusseted, the sleeve 24 is then seamed closed at 28 to join together and close the bottom of the bag with the lower portions of the faces 12 and 14 being connected with each other and with the opposite inwardly gusseted sides 16 and 18 being automatically secured and joined therebetween to the adjacent outer faces 12 and 14 by the seam 28. When formed with the seam 28, the sleeve 24 of FIG. 4 now becomes the bag 10 and is so generally identified beginning in FIG. 5.

The bag 10 of FIG. 5 is next pressed flat by placing the seamed bottom thereof against a surface 30 and inserting into the bag a plunger 32 having the flat shape which the bag bottom is to assume. In so doing, the bag may be held and the plunger inserted into it or the plunger may be stationary and the bag moved over the plunger, or a combination of such movements may be performed. Thus, if it is desired to provide the bag 10 with a square bottom, the plunger 32 will be substantially square in shape. If the bag bottom is to be rectangular by reason of the relative width of the sides 16 and 18 in relation to the faces 12 and 14, then the plunger 32 will assume such rectangular shape. The plunger 32 is then inserted into the open end 34 of the bag 10 such as is shown in FIG. 6. During this operation of insertion of the plunger 32 into the bag 10, the gusseted sides 16 and 18 are straightened outward by the air exiting around the plunger walls so that the sides are substantially flat and planar and the gusset fold lines 26 thereof become inoperative.

As the plunger 32 moves downwardly through the opening 34 and along the length of the bag and finally down to the bottom, it presses against the previously gusseted sides 16 and 18 to press them downwardly against the adjacent surfaces of the faces 12 and 14. During the final movement, the plunger progressively presses flat the surfaces 12 and 14 against the die surface 30 so that the bottom of the bag 10 assumes the shape of the plunger 32. As a consequence, the resultant bag shape may take the appearance of the plunger as illustrated in FIG. 7.

Those skilled in the art will recognize that the description made of the present invention and the references to flat bottom bags include all such flat bottom bags, whether the shape of the bottom be square, rectangular or of any other configuration. During the downward and pressing movement of the plunger 32 against the internal surfaces of the bag 10 causing them to assume the desired end bottom shape, certain fold lines result. That is to say, the faces 12 and 14 are now provided with bottom defining fold lines 36 while the sides 16 and 18 are provided with edge fold lines 38. Also during the formation of such fold lines, the portions of the sides 16 and 18 previously sealed between the faces 12 and 14 when they had assumed their gusseted shape such as is illustrated in FIGS. 4 and 5, each now has a portion thereof forming a substantially triangular shape flap 40 that is pressed downwardly adjacent to and in overlying relationship against the inside surfaces of the faces 12 and 14. The flaps 40 are formed along fold lines 42 as illustrated more clearly in FIG. 7.

Those skilled in the art will recognize that the material of which the bag 10 is constructed is not limiting upon the scope of the invention. It will be recognized that if the bag 10 is fabricated of a plastic material, such plastic material is easily heat sealed such that adjacent surfaces, fold lines and other portions thereof may be seamed and welded so as to be joined together simply by the application of heat. However, if the bag is made of paper or fabric, the adjacent portions thereof may be joined together either by glue, adhesives, staples or sewing. For ease of understanding the present invention, it will be assumed that the material of which the bag 10 is made is plastic and, therefore, portions to be joined together may be conveniently accomplished by heat welding or sealing in any conventional and well known manner. In such case, the bottom of the plunger 32 may be provided with certain preselected portions (not shown) that will cooperate with certain portions on the die surface 30 so as to create a heat weld and joint or seal between preselected portions of the sides 16 and 18 and their related flaps 40 with adjacent overlying surfaces of the faces 12 and 14, after the bottom of the bag 10 has been pressed flat and the details thereof positioned in overlying relationship such as is illustrated in FIGS. 6 and 7.

In this connection, reference is now made to the embodiment illustrated in FIG. 8 wherein the initial first seal formed by the seam 28 is supplemented by welds or seams 44 depicted by double lines. The seams 44 are shown positioned along the edges defined by the end fold lines 38 on the sides 16 and 18 to join together the adjacent edges of such sides 16 and 18 with the adjacent edges of the faces 12 and 14 defining the bag bottom. The joining seams 44 extend in the direction of the width of each of the sides 16 and 18 and substantially for the full extent thereof. By so doing, access to the folds of the flaps 40 between the edges 38 of the sides 16 and 18 and the adjacent folds of the faces 12 and 14, is prevented and closed. As a consequence, the double-seal effected by the seams 28 and 44 retain the shape of the bag bottom to that defined by the cooperation of the plunger 32 with the die surface 30.

The flaps 40 are positioned on the inside of the bag 10 and held in their flat position against the flat bottom. This retention of the flaps 40 against the flat bottom of the bag, which has been formed in part by the faces 12 and 14 being folded at their lines 36, forms a double bottom wall. When goods or other articles are placed within the bag 10, they first rest upon the flaps 40 which are supported by the seam 28 and by the faces 12 and 14. Because of the double thickness of the flaps 40 resulting from the gusseting of the sides 16 and 18, and further because of the secondary seals 44, the initial weight and force of the contents placed in the bag is supported by the flaps 40 which are reinforced by the underlying portions of the faces 12 and 14.

In referring to the embodiment of FIG. 9, the underlying portions of the faces 12 and 14 positioned beneath the gusseted flaps 40 are secured to the sides 16 and 18 and their gusseted flaps 40 by secondary seal means 46 which join together the underlying portions of the faces 12 and 14 to such adjacently positioned flaps 40 of the sides 16 and 18. The secondary seals 46 are positioned slightly inward from the edges 38 of the sides 16 and 18 and may extend for only a portion of the width of such sides. The seals 46 are illustrated in FIG. 9 by the double lines and it is there shown that the seals 46 extend between the fold lines 42 of the flaps 40.

The seal lines 46 function in the same manner as the previously described seal lines 44 in that they close off access to the interior of the flaps 40 and create a unitary arrangement of structure. Such structure includes the flaps 40 and the underlying adjacent surfaces of the faces 12 and 14. This results in a unitary base in which the forces supported and absorbed by the flaps 40 are transmitted to the underlying portions of the faces 12 and 14. Thus, the bottom of the bag 10 is fluid-tightly closed and made imperforate by the double-seal construction.

In FIG. 10, the overlying relationship of the gusseted flaps 40 with the adjacent portions of the faces 12 and 14 forming the flat bottom of the bag 10, are sealed and secured together by double-lined secondary seaming sealing means 48. The secondary seals 48 join together bottom portions of the faces 12 and 14 with the gusset flaps 40 along the fold lines 42 thereof so as to prevent the separation of the flaps 40 from the adjacent surfaces of the faces 12 and 14. Once again, the integrity of the flat base of the bag 10 is maintained in the same manner as described with respect to FIGS. 8 and 9 and the inwardly gusseted flaps 40 are retained in position to initially support and absorb all forces of goods that are placed within the bag 10.

In referring to FIG. 11, the bag bottom there shown combines the teaching of the secondary seals 44 illustrated in FIG. 8 with the seals 48 previously described with respect to FIG. 10. The combination of the initial seal 28 with the secondary seals 44 positioned along the edges 38 of the sides 16 and 18 with respect to the adjacent edges formed by the bottom portions of the faces 12 and 14, closes the interiors of the flaps 40 fluid-tightly while the additional seals 48 provide for additional structural support between the flaps 40 and the adjacent surfaces of the faces 12 and 14.

The embodiment of FIG. 12 also teaches the combination of utilizing the secondary seals 46 discussed with respect to FIG. 9 in combination with the additional seals 48 described with respect to FIG. 10. The resulting benefits thereof would appear to be obvious to those skilled in the art and as previously described.

It is apparent from the disclosure that in addition to the secondary seals 44, 46 and 48 taught in the embodiments of FIGS. 8 to 12 inclusive, one may completely seam to seal and secure so as to join together the adjacent overlying and related portions of the flaps 40 with those surfaces of the faces 12 and 14 adjacent thereto. Thus, in referring to any of the FIGS. 8 to 12 of the drawing, but in particular to FIG. 8 once again, the whole or any substantial preselected portion of any of the flaps 40 illustrated therein may be heat sealed to the adjacent surfaces of the faces 12 and 14 forming the base of the bag 10. This would seem to be amply illustrated in and obvious from FIG. 8. When the bag is made of paper, an adhesive or glue is utilized, with or without the further use of staples. In the event the bag were made of fabric or cloth, stitching, glue and other adhesives could be utilized, with or without staples.

What has been taught is an unusually simple and inexpensive flat bottom bag that is of unitary construction having a double-thick base in which the gusseted folds and flaps, secured to the faces forming the bottom of the bag, create a unitary construction. In such construction the folds, side walls and faces all function as a unitary singular structure to support the contents of the bag and divide the weight equally between them. The double-seals created at the bottom of the bag prevent the separation of the folds from the faces and thereby retain the imperforate integrity of the flat bottom of such bag.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. As an article of manufacture, a double-sealed flat bottom bag of heat sealable material comprising a seam heat sealing closed the bag bottom and defining opposite inwardly gusseted sides, said inwardly gusseted sides being sealed to the bag bottom by said sealing seam for automatically forming flaps in overlying relationship with said closed bottom when the bag bottom is pressed flat, and said overlying flaps and closed bottom being heat sealed together in their flat overlying relationship by further sealing means extending across the width of the bag and said flaps.

2. An article of manufacture as in claim 1, said further sealing means joining said closed bag bottom and gusseted sides together for substantially the full width of said gusseted sides.

3. An article of manufacturing as in claim 1, said flaps of said opposite gusseted sides having folds adjacent said closed bag bottom, and said further sealing means extending along and joining said folds to the adjacent bag bottom.

4. An article of manufacture as in claim 3, and said further sealing means also joining said closed bag bottom and opposite gusseted sides together along said opposite gusseted sides.

5. A double-sealed flat bottom bag of heat sealable material comprising opposed faces and opposed sides, a seam heat sealing closed the opposed faces together at the bottom with said opposed sides gusseted inward and heat sealed therebetween, further heat sealing means joining together preselected adjacent portions of said faces and sides for the width of said bag when the bottom of the bag is pressed flat and said faces and sides are positioned in adjacent overlying relationship.

6. A double-sealed flat bottom bag as in claim 5, said further sealing means joining together adjacent portions of said faces and sides for substantially the full width of said sides when the bottom of the bag is pressed flat.

7. A double-sealed flat bottom bag as in claim 5, said further sealing means joining together the edges of said faces and the overlying edges of said sides formed when the bottom of the bag is pressed flat.

8. A double-sealed flat bottom bag as in claim 5, said further sealing means extending along folds of said inwardly gusseted sides to join the same to adjacent portions of said faces when the bottom of the bag is pressed flat.

9. A double-sealed flat bottom bag as in claim 8, said further sealing means joining together adjacent portions of said faces and sides in the direction of the width of said sides when the bottom of the bag is pressed flat.

* * * * *